US011289020B2

(12) United States Patent
Han et al.

(10) Patent No.: US 11,289,020 B2
(45) Date of Patent: Mar. 29, 2022

(54) DISPLAY DEVICE, POWER SUPPLY CIRCUIT AND POWER SUPPLY METHOD

(71) Applicant: BOE TECHNOLOGY GROUP CO., LTD., Beijing (CN)

(72) Inventors: Xinbin Han, Beijing (CN); Xin Wang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 918 days.

(21) Appl. No.: 16/064,612

(22) PCT Filed: Jan. 10, 2018

(86) PCT No.: PCT/CN2018/072063

§ 371 (c)(1),
(2) Date: Jun. 21, 2018

(87) PCT Pub. No.: WO2019/000903

PCT Pub. Date: Jan. 3, 2019

(65) Prior Publication Data

US 2021/0210015 A1 Jul. 8, 2021

(30) Foreign Application Priority Data

Jun. 30, 2017 (CN) ..... 201710525756.1

(51) Int. Cl.
*G09G 3/3258* (2016.01)

(52) U.S. Cl.
CPC ... *G09G 3/3258* (2013.01); *G09G 2310/0243* (2013.01); *G09G 2330/025* (2013.01); *G09G 2330/027* (2013.01); *G09G 2330/08* (2013.01)

(58) Field of Classification Search
None
See application file for complete search history.

(56) References Cited

U.S. PATENT DOCUMENTS

2003/0184538 A1* 10/2003 Yamato ..... G09G 3/3696 345/211
2009/0058311 A1* 3/2009 Eom ..... H05B 45/60 315/173

(Continued)

FOREIGN PATENT DOCUMENTS

CN 101110186 A 1/2008
CN 101334969 A 12/2008

(Continued)

OTHER PUBLICATIONS

International Search Report of PCT/CN2018/072063 in Chinese, dated Mar. 27, 2018 with English translation.

(Continued)

*Primary Examiner* — Matthew Yeung
(74) *Attorney, Agent, or Firm* — Collard & Roe, P.C.

(57) ABSTRACT

A display device, a power supply circuit and a power supply method are provided. The power supply circuit includes a control sub-circuit and a delay sub-circuit. The control sub-circuit is configured to provide a first preset voltage and a second preset voltage and output the first preset voltage to a first power supply terminal; and delay sub-circuit is configured to delay the second preset voltage and output the delayed second preset voltage to a second power supply terminal.

18 Claims, 4 Drawing Sheets

(56) References Cited

U.S. PATENT DOCUMENTS

| | | | |
|---|---|---|---|
| 2011/0157241 | A1 | 6/2011 | Lee et al. |
| 2011/0187337 | A1 | 8/2011 | Lin et al. |
| 2011/0317317 | A1 | 12/2011 | Liu et al. |
| 2018/0218675 | A1 | 8/2018 | Zhang et al. |

FOREIGN PATENT DOCUMENTS

| | | | |
|---|---|---|---|
| CN | 102110423 | A | 6/2011 |
| CN | 105469742 | A | 4/2016 |
| CN | 106601207 | A | 4/2017 |
| CN | 107103871 | A | 8/2017 |

OTHER PUBLICATIONS

Notice of Transmittal of the International Search Report of PCT/CN2018/072063 in Chinese, dated Mar. 27, 2018.
Written Opinion of the International Searching Authority of PCT/CN2018/072063 in Chinese, dated Mar. 27, 2018 with English translation.

* cited by examiner

DISPLAY DEVICE, POWER SUPPLY CIRCUIT AND POWER SUPPLY METHOD

CROSS REFERENCE TO RELATED APPLICATIONS

This application is the National Stage of PCT/CN2018/072063 filed on Jan. 10, 2018, which claims priority under 35 U.S.C. § 119 of Chinese Application No. 201710525756.1 filed on Jun. 30, 2017, the disclosure of which is incorporated by reference.

TECHNICAL FIELD

Embodiments of the present disclosure relate to a display device, a power supply circuit and a power supply method.

BACKGROUND

When a current leakage failure or a short-circuit failure occurs in a display device, power-off protection is generally performed. The display device can be protected by the power-off protection so that the data being processed is not lost or the function is not damaged. However, the power-off protection may cause that the subsequent detection of the display device cannot be performed.

SUMMARY

According to one aspect of the present disclosure, at least one embodiment provides a power supply circuit, comprising: a control sub-circuit, configured to provide a first preset voltage and a second preset voltage and output the first preset voltage to a first power supply terminal; and a delay sub-circuit, configured to delay the second preset voltage and output the delayed second preset voltage to a second power supply terminal In addition, according to an embodiment, the control sub-circuit is a power chip; the power chip comprises a first output terminal and a second output terminal, the first output terminal is configured to provide the first preset voltage, and the second output is configured to provide the second preset voltage, the first output terminal is used as the first power supply terminal; and the delay sub-circuit comprises an input terminal and an output terminal, the input terminal is connected to the second output terminal of the power chip, the output terminal of the delay sub-circuit is connected to the second power supply terminal to delay the second preset voltage provided by the power chip and output the delayed second preset voltage to the second power supply terminal, the first power supply terminal is connected to a first power receiving terminal of a display screen, and the second power supply terminal is connected to a second power receiving terminal of the display screen.

In addition, according to an embodiment, the delay sub-circuit comprises: a first switch transistor, a second switch transistor, and a voltage division and delay sub-circuit. A control terminal of the first switch transistor is connected to the input terminal of the delay sub-circuit, and a first terminal of the first switch transistor is grounded; a first terminal of the second switch transistor is connected to the input terminal of the delay sub-circuit, and a second terminal of the second switch transistor is connected to the output terminal of the delay sub-circuit; a first terminal of the voltage division and delay sub-circuit is connected to the input terminal of the delay sub-circuit, and a second terminal of the voltage division and delay sub-circuit is connected to the second terminal of the first switch transistor, a voltage division terminal of the voltage division and delay sub-circuit is connected to a control terminal of the second switch transistor, and a delay terminal of the voltage division and delay sub-circuit is connected to the output terminal of the delay sub-circuit after the delay terminal of the voltage division and delay sub-circuit is connected to the second terminal of the second switch transistor.

In addition, according to an embodiment, the first switch transistor is an NMOS transistor, and the second switch transistor is a PMOS transistor.

In addition, according to an embodiment, where the second preset voltage provided by the control sub-circuit is input to the input terminal of the delay sub-circuit, the first switch transistor is turned on under the driving of the second preset voltage; the voltage division and delay sub-circuit is configured to divide the second preset voltage provided by the power chip after the first switch transistor is turned on to generate a divided voltage signal and output the divided voltage signal through the voltage division terminal to the second switch transistor to drive the second switch transistor to be turned on; after the second switch is turned on, the second preset voltage is delayed to be output.

In addition, according to an embodiment, the voltage division and delay sub-circuit comprises: a first resistor and a second resistor. A first terminal of the first resistor is used as the second terminal of the voltage division and delay sub-circuit, and a second terminal of the first resistor is connected to the voltage division terminal of the voltage division and delay sub-circuit; a first terminal of the second resistor is used as the first terminal of the voltage division and delay sub-circuit, and a second terminal of the second resistor is connected to the voltage division terminal of the voltage division and delay sub-circuit.

In addition, according to an embodiment, the voltage division and delay sub-circuit further comprises: a first capacitor, a first terminal of the first capacitor is connected to the voltage division terminal of the voltage division and delay sub-circuit, and a second terminal of the first capacitor is used as the delay terminal of the voltage division and delay sub-circuit.

In addition, according to an embodiment, the voltage division and delay sub-circuit further comprises: a second capacitor, a first terminal of the second capacitor is connected to the first terminal of the second resistor, and a second terminal of the second capacitor is connected to the second terminal of the second resistor.

In addition, according to an embodiment, a preset delay time period of the delay sub-circuit is R1*C1*Ln ((ELVDD_IN−ELVDD_OUT)/ELVDD_IN), where R1 is a resistance value of the first resistor, C1 is a capacitance value of the second capacitor, ELVDD_IN is a voltage of the input terminal of the delay sub-circuit, ELVDD_OUT is a voltage of the output terminal of the delay sub-circuit, and Ln is a natural logarithm.

According to another aspect of the present disclosure, at least one embodiment provides a display device, comprising any of the above power supply circuits.

According to another aspect of the present disclosure, at least one embodiment provides a power supply method, comprising: outputting a first preset voltage provided by a control sub-circuit to a first power supply terminal; and delaying a second preset voltage provided by the control sub-circuit by a delay sub-circuit, and outputting the delayed second preset voltage to a second power supply terminal.

In addition, according to an embodiment, the control sub-circuit is a power chip; the first preset voltage is provided by a first output terminal of the power chip, and the first preset voltage provided by the power chip is output to the first power supply terminal; the second preset voltage is provided by a second output terminal of the power chip, the second preset voltage is delayed to be output, and the delayed second output voltage is output to the second power supply terminal.

In addition, according to an embodiment, the delay sub-circuit comprises a first switch transistor and a second switch transistor, and delaying the second preset voltage provided by the control sub-circuit by the delay sub-circuit comprises: acquiring the second preset voltage provided by the control sub-circuit, wherein the first switch transistor is turned on under driving of the second preset voltage; after the first switch transistor is turned on, the second preset voltage provided by the power chip is divided to generate a divided voltage signal, wherein the second switch transistor is turned on under driving of the divided voltage signal; and after the second switch transistor is turned on, the second preset voltage is delayed to be output.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

Figure 1:
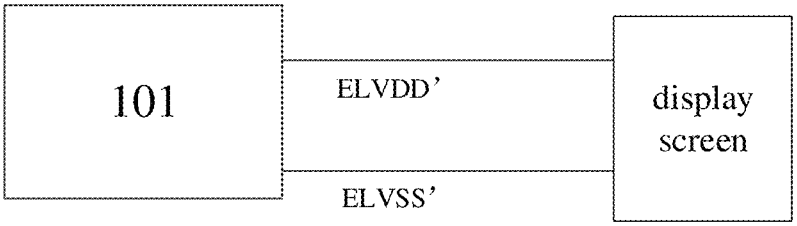
FIG. 1 is a schematic diagram of a power supply circuit according to an embodiment of the present disclosure.

At present, a power supply circuit for a display screen is illustrated in FIG. 1, the power supply circuit comprises a control sub-circuit, and the control sub-circuit is, for example, a power chip 101. The power chip 101 generates a first preset voltage ELVDD' and a second preset voltage ELVSS', which are for driving each pixel circuit in the display screen. According to the design principle of the power chip, the voltage ELVSS' is powered after the voltage ELVDD' is powered, but the difference between the time when the voltage ELVDD' is powered and the time when the voltage ELVSS' is powered is small.

During the powering process of the display screen of a display device, there are two pulse currents in the power chip when the voltage jumps. Due to external interference, the two pulse currents may form a large pulse current, and the voltage ELVSS' generated by the power chip may be pulled up to more than 0V. Where there is a large current in the power chip or the voltage ELVSS' is pulled up to more than 0V, the power chip recognizes that an abnormal event occurs and performs power-off protection. However, the power-off protection performed during the powering process may cause that the subsequent detection of the display device cannot be performed.

Hereinafter, a display device, a power supply circuit and a power supply method of embodiments of the present disclosure are described with reference to the accompanying drawings.

Figure 2:
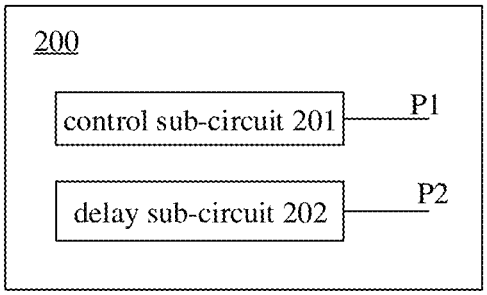
FIG. 2 is a schematic diagram of a power supply circuit according to an embodiment of the present disclosure.

At least one embodiment of the present disclosure provides a schematic diagram of a power supply circuit as illustrated in FIG. 2. The power supply circuit 200 is used for powering a display screen of a display device, for example. The display device is, for example, an organic light emitting diode (OLED) display device, correspondingly, the display screen of the OLED display device is an OLED display screen (or display panel).

As illustrated in FIG. 2, the power supply circuit comprises a control sub-circuit 201 and a delay sub-circuit 202. The control sub-circuit 201 is configured to provide a first preset voltage and a second preset voltage and output the first preset voltage to a first power supply terminal P1; and the delay sub-circuit 202 is configured to delay a second preset voltage and output the delayed second preset voltage to a second power supply terminal P2.

Figure 3:
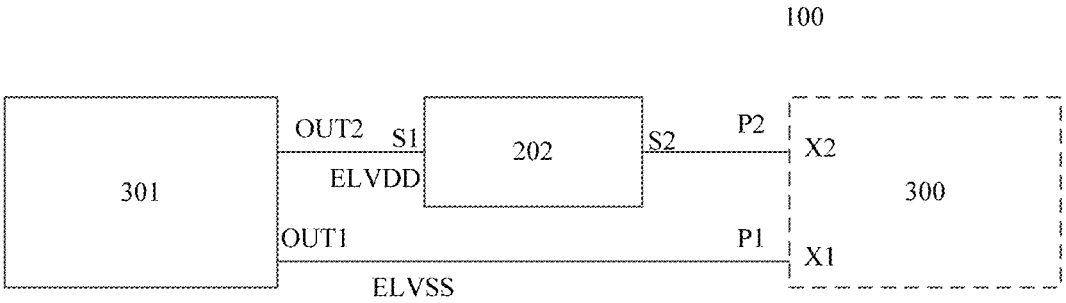
FIG. 3 is a schematic diagram of a power supply circuit according to an embodiment of the present disclosure.

Here, for example, the control sub-circuit 201 can be implemented as a power chip, and the power chip can be a semiconductor integrated circuit chip. As illustrated in FIG. 3, the power chip 301 comprises a first output terminal OUT1 and a second output terminal OUT2. The first output terminal OUT1 is configured to provide a first preset voltage, and the second output terminal OUT2 is configured to provide a second preset voltage, and the first output terminal OUT1 is used as the first power supply terminal P1. The delay sub-circuit comprises an input terminal S1 and an output terminal S2, the input terminal S1 is connected to the second output terminal OUT2 of the power chip, and the output terminal S2 of the delay sub-circuit is connected to the second power supply terminal P2 to delay the second preset voltage provided by the power chip and output the delayed second preset voltage to the second power supply terminal P2. The first power supply terminal P1 is connected to a first power receiving terminal X1 of a display screen 300, and the second power supply terminal P2 is connected to a second power receiving terminal X2 of the display screen 300.

The power-off protection caused by a large current or a voltage that is pulled up during the powering process of the power chip can be effectively avoided by the power supply circuit in the embodiment of the present disclosure, and the power-off protection can be avoided as much as possible while preventing the display screen from being damaged, so that the subsequent detection can be assuredly performed in a normal way. The circuit has a simple structure and good compatibility.

In a specific example, the power chip 301 comprises a first output terminal OUT1 and a second output terminal OUT2. The power chip 301 provides a first preset voltage ELVSS through the first output terminal OUT1, and the power chip 301 provides a second preset voltage ELVDD through the second output terminal OUT2, and the first output terminal OUT1 of the power chip 301 is configured to be connected to the first power receiving terminal X1 of the display screen 300 to provide the first preset voltage ELVSS provided by the power chip 301 to the first power receiving terminal X1. The input terminal S1 of the delay sub-circuit 202 is connected to the second output terminal OUT2 of the power chip 301, and the output terminal S2 of the delay sub-circuit 202 is connected to the second power receiving terminal X2 of the display screen 300. The delay sub-circuit 202 is configured to delay and output the second preset voltage ELVDD provided by the power chip 301 so as to delay the second preset voltage ELVDD provided by the power chip 301 for a preset delay time period and then provide the delayed second preset voltage ELVDD to the second power receiving terminal X2.

For example, the delay sub-circuit 202 is connected between the second output terminal OUT2 of the power chip 301 and the second power receiving terminal X2 of the display screen 300, so that the second preset voltage ELVDD can be delayed for a preset delay time period such as 20 ms and then be provided to the second power receiving terminal X2 of the display screen 300. As a result, after the power chip 301 starts to output power under the control of a power enable signal OLED_EN, the second preset voltage ELVDD can be powered after the first preset voltage ELVSS is powered stably, that is, the second preset voltage ELVDD can be provided to the second power receiving terminal X2 after the first preset voltage ELVSS provided to the first power receiving terminal X1 has been stable, so that the difference between the time when the second preset voltage ELVDD is powered and the time when the first preset voltage ELVSS is powered can be increased, and the power-off protection caused by the phenomenon that the voltage ELVSS is pulled up can be avoided, an excessively large pulse current can be prevented from being generated in the power chip 301, the power-off protection can be avoided as much as possible while preventing the display screen from being damaged, and the subsequent detection can be assuredly performed in a normal way.

It should be noted that, the power chip 301 can further comprise a power conversion unit, and, after the power conversion unit converts the second preset voltage ELVDD to the first preset voltage ELVSS, the power conversion unit can first output the first preset voltage ELVSS through the first output terminal OUT1, and then output the second preset voltage ELVDD through the second output terminal OUT2; therefore, the second preset voltage ELVDD and the first preset voltage ELVSS can be sequentially generated, however because the conversion time of the power conversion unit is short, the second preset voltage ELVDD and the first preset voltage ELVSS can also be regarded as being generated substantially at the same time.

Figure 4:
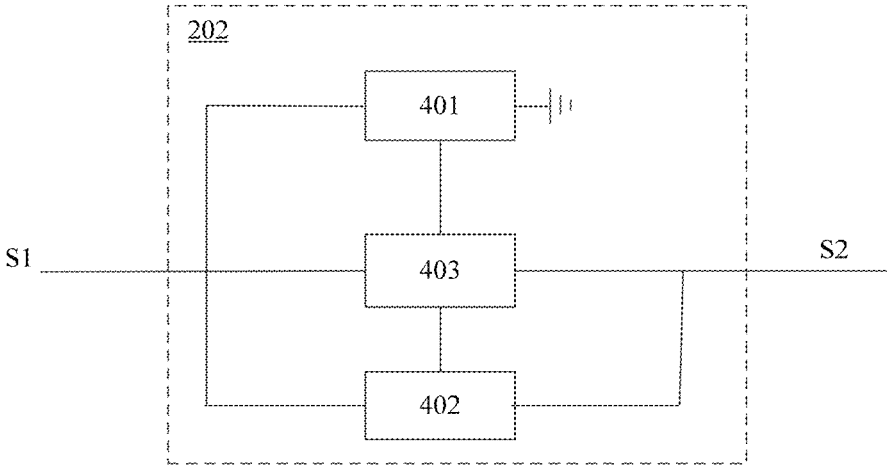
FIG. 4 is a schematic diagram of a delay sub-circuit according to an embodiment of the present disclosure.

In addition, according to an embodiment of the present disclosure, as illustrated in FIG. 4, the delay sub-circuit 202 comprises a first switch transistor 401, a second switch transistor 402, and a voltage division and delay sub-circuit 403. A control terminal of the first switch transistor 401 is connected to the input terminal S1 of the delay sub-circuit 202, and a first terminal of the first switch transistor 401 is grounded. A first terminal of the second switch transistor 402 is connected to the input terminal S1 of the delay sub-circuit 202, and a second terminal of the second switch transistor 402 is connected to the output terminal S2 of the delay sub-circuit 202. A first terminal of the voltage division and delay sub-circuit 403 is connected to the input terminal S1 of the delay sub-circuit 202, a second terminal of the voltage division and delay sub-circuit 403 is connected to a second terminal of the first switch transistor 401, and a voltage division terminal of the voltage division and delay sub-circuit 403 is connected to a control terminal of the second switch transistor 402. A delay terminal of the voltage division and delay sub-circuit 403 is connected to the output terminal S2 of the delay sub-circuit 202 after the delay terminal is connected to the second terminal of the second switch transistor 402.

Figure 5:
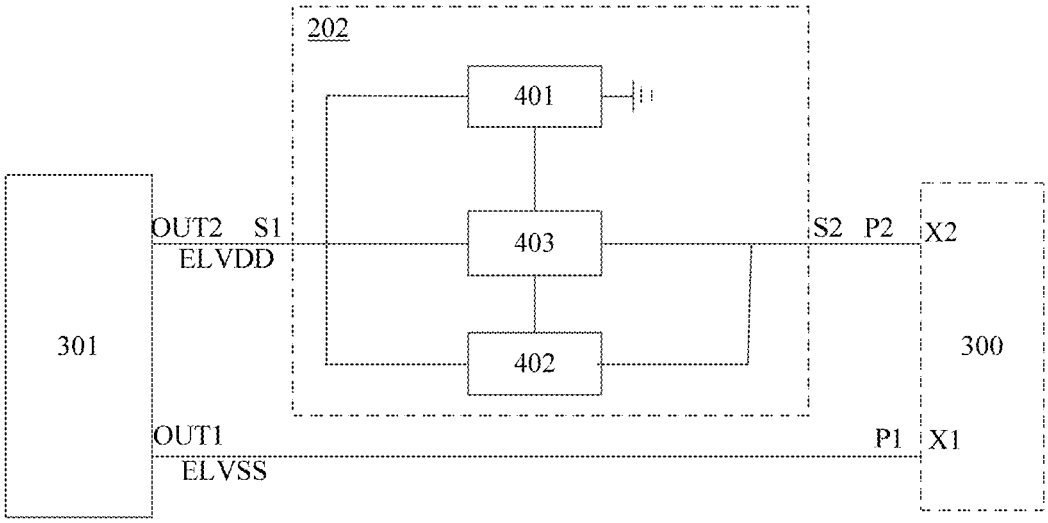
FIG. 5 is a schematic diagram of a delay sub-circuit according to an embodiment of the present disclosure.

Herein, the first switch transistor comprises three terminals, which are the control terminal, the first terminal and the second terminal, respectively. The second switch transistor also comprises three terminals, which are the control terminal, the first terminal and the second terminal, respectively. The voltage division and delay sub-circuit 403 comprises four terminals, which are the first terminal, the second terminal, the voltage division terminal and the delay terminal, respectively. For example, as illustrated in FIG. 5, the delay sub-circuit 202 comprises a first switch transistor 401, a second switch transistor 402 and a voltage division and delay sub-circuit 403. Because the input terminal S1 of the delay sub-circuit 202 is connected to the second output terminal OUT2 of the power chip 301, the output terminal S2 of the delay sub-circuit 202 is connected to the second power receiving terminal X2 of the display screen 300, that is, the control terminal of the first switch transistor 401 is connected to the second output terminal OUT2 of the power chip 301, and the first terminal of the first switch transistor 401 is grounded; the first terminal of the second switch transistor 402 is connected to the second output terminal OUT2 of the power chip 301; the first terminal of the voltage division and delay sub-circuit 403 is connected to the second output terminal OUT2 of the power chip 301, the second terminal of the voltage division and delay sub-circuit 403 is connected to the second terminal of the first switch transistor 401, the voltage division terminal of the voltage division and delay sub-circuit 403 is connected to the control terminal of the second switching transistor 402, and the delay terminal of the voltage division and delay sub-circuit 403 is configured to be connected to the second power receiving terminal X2 of the display screen 300 after the delay terminal is connected to the second terminal of the second switching transistor 402.

The first switch transistor 401 is turned on under the driving of the second preset voltage ELVDD. The voltage division and delay sub-circuit 403 is configured to divide the second preset voltage ELVDD provided by the power chip 301 to generate a divided voltage signal after the first switch transistor 401 is turned on, and output the divided voltage signal to the second switch transistor 402 through the voltage division terminal so as to drive the second switch transistor 402 to be turned on, and delay and output the second preset voltage ELVDD after the second switch transistor 402 is turned on.

In an optional embodiment, the voltage division and delay sub-circuit 403 comprises a first resistor and a second resistor. A first terminal of the first resistor is used as the second terminal of the voltage division and delay sub-circuit, and a second terminal of the first resistor is connected to the voltage division terminal of the voltage division and delay sub-circuit. A first terminal of the second resistor is used as the first terminal of the voltage division and delay sub-circuit, and a second terminal of the second resistor is connected to the voltage division terminal of the voltage divide and the delay sub-circuit.

Figure 6:
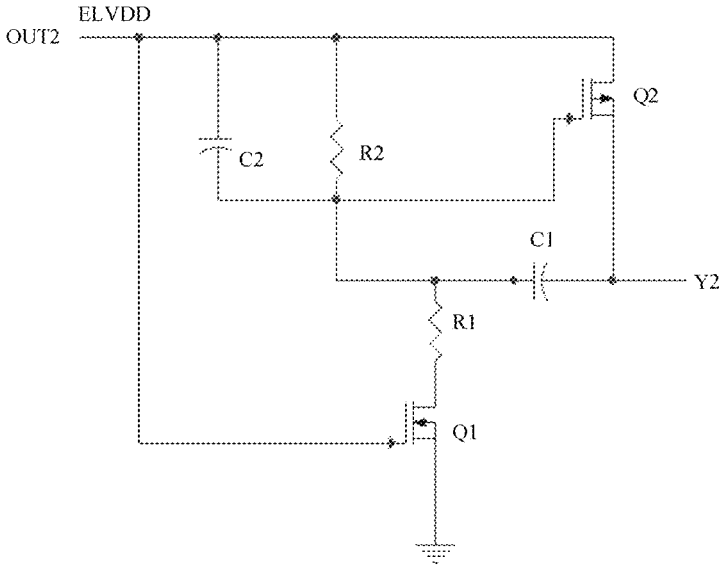
FIG. 6 is a schematic diagram of a delay sub-circuit according to an embodiment of the present disclosure.

For example, in FIG. 6, the first resistor is indicated as R1 and the second resistor is indicated as R2. That is, a terminal of the first resistor R1 is connected to the second terminal of the first switch transistor 401 (for example, Q1), a terminal of the second resistor R2 is connected to the second output terminal OUT2 of the power chip 201, the other terminal of the second resistor R2 is connected to the other terminal of the first resistor R1 and there is a first node between the first resistor R1 and the second resistor R2, and the first node is connected to the control terminal of the second switch transistor 402 (for example, Q2).

Here, the voltage division and delay sub-circuit 403 further comprises a first capacitor and a second capacitor. A first terminal of the first capacitor is connected to the voltage division terminal of the voltage division and delay sub-circuit, and a second terminal of the first capacitor is used as the delay terminal of the voltage division and delay sub-circuit. A first terminal of the second capacitor is connected to the first terminal of the second resistor, and a second terminal of the second capacitor is connected to the second terminal of the second resistor.

For example, in FIG. 6, the first capacitor is indicated as C1, a terminal of the first capacitor C1 is connected to the other terminal of the first resistor R1, and the other terminal of the first capacitor C1 is connected to the second terminal of the second switch transistor Q2 and there is a second node between the first capacitor C1 and the second switch transistor Q2, and the second node is used for connection to the second power receiving terminal X2 of the display screen 300. The second capacitor is indicated as C2, and the second capacitor C2 is connected in parallel with the second resistor R2.

That is, the first resistor R1 and the second resistor R2 can divide the second preset voltage ELVDD, and the first resistor R1 and the first capacitor C1 can constitute an RC delay sub-unit to delay the second preset voltage ELVDD for a preset time period and then output the second preset voltage ELVDD.

Optionally, in the example illustrated in FIG. 6, the first switch transistor Q1 can be an NMOS transistor, and the second switch transistor Q2 can be a PMOS transistor, but the embodiment of the present disclosure is not limited in this aspect. The second terminal of the first switch transistor Q1 is a drain electrode of the NMOS transistor, that is, a D electrode. The first terminal of the first switch transistor Q1 is a source electrode of the NMOS transistor, that is, an S electrode. The control terminal of the first switch transistor Q1 is a gate electrode of the NMOS transistor, that is, a G electrode. The NMOS transistor can be turned on under the driving of the second preset voltage ELVDD. The control terminal of the second switch transistor Q2 is a gate electrode of the PMOS transistor, that is, a G electrode. The first terminal of the second switch transistor Q2 is a source electrode of the PMOS transistor, that is, an S electrode. The second terminal of the second switch transistor Q2 is a drain electrode of the PMOS transistor, that is, a D electrode.

It can be seen from the above that the preset delay time period of the delay and output process of the second preset voltage ELVDD is related to a resistance value of the first resistor R1 and a capacitance value of the first capacitor C1. The preset delay time period is R1*C1*Ln ((ELVDD_IN−ELVDD_OUT)/ELVDD_IN), where R1 is the resistance value of the first resistor, C1 is the capacitance value of the first capacitor, and ELVDD_IN is a voltage of the input terminal of the delay sub-circuit 403, ELVDD_OUT is a voltage of the output terminal of the delay sub-circuit 403, and Ln represents a natural logarithm, that is, a logarithm with the base of the constant e.

The operation principle of the delay sub-circuit 403 of the above embodiments of the present disclosure is described below with reference to FIG. 6.

Where the power chip 301 outputs the second preset voltage ELVDD through the second output terminal OUT2, in a situation that the first switch transistor Q1 is not turned on, the voltage of the source electrode of the second switch transistor Q2 is equal to the second preset voltage ELVDD, the voltage of the gate electrode of the second switch transistor Q2 is pulled up to the second preset voltage ELVDD by the second resistor R2, and the voltage of the gate electrode of the second switch transistor Q2 is equal to the voltage of the source electrode of the second switch transistor Q2, the second switch transistor Q2 is turned off, and there is no output at the drain electrode of the second switch transistor Q2, that is, the output terminal (for example, Y2) of the delay sub-circuit 403.

Where the voltage of the gate electrode of the first switch transistor Q1 is pulled up to allow the first switch transistor Q1 to be turned on, because of the voltage division function of the second resistor R2 and the first resistor R1, the voltage of the gate electrode of the second switch transistor Q2 is lower than the voltage of the source electrode of the second switch transistor Q2, and the second switch transistor Q2 is turned on. After the second switch transistor Q2 is turned on, the second preset voltage ELVDD charges the RC circuit formed by the first capacitor C1 and the first resistor R1 through the second switch transistor Q2. Where the RC circuit is charged to be full, the drain electrode of the second switch transistor Q2, that is, the output terminal (for example, Y2) of the delay sub-circuit 403 outputs the second preset voltage ELVDD to the second power receiving terminal X2 of the display screen 300. Therefore, in this case that the delay is performed by the RC circuit, the delay time can be about R1*C1*Ln ((ELVDD_IN−ELVDD_OUT)/ELVDD_IN).

Figure 7:
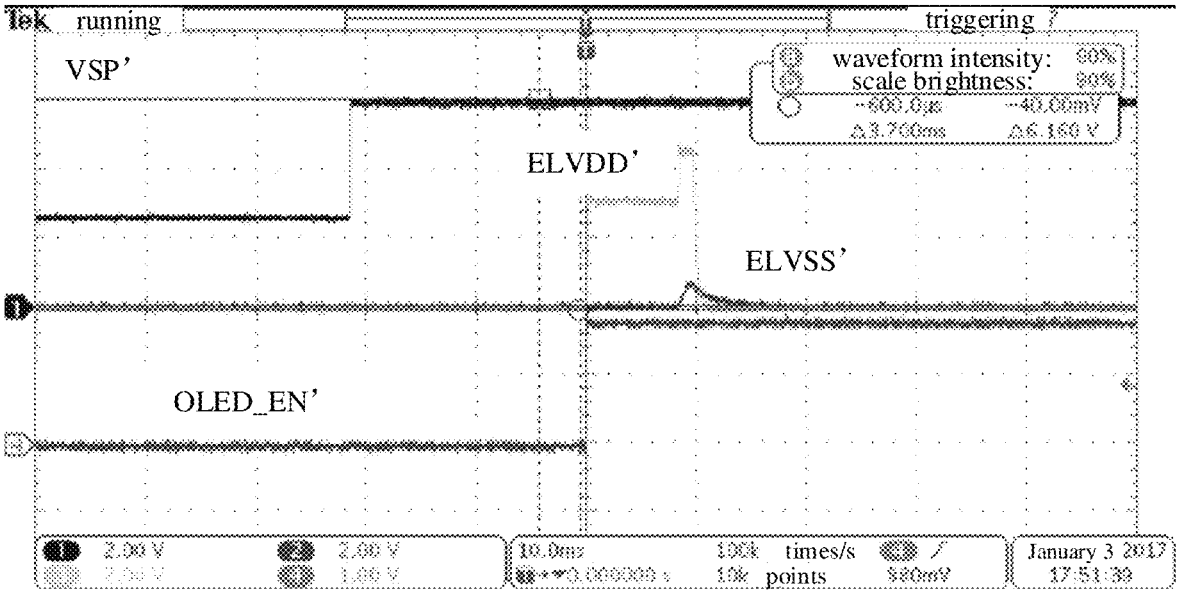
FIG. 7 is a waveform diagram of a first power supply and a second power supply of a power chip according to an embodiment of the present disclosure, in which the second power supply is pulled up to more than 0V.

As a result, the difference between the time when the second preset voltage ELVDD is powered and the time when the first preset voltage ELVSS is powered can be increased to avoid the power-off protection caused by the phenomenon that the voltage ELVSS is pulled up (a waveform of the voltage ELVSS that is pulled up is illustrated in FIG. 7), and an excessively large pulse current can be prevented from being generated in the power chip, the power-off protection performed during the powering process can be avoided as much as possible while preventing the display screen from being damaged, and the subsequent detection can be assuredly performed in a normal way.

Figure 8:
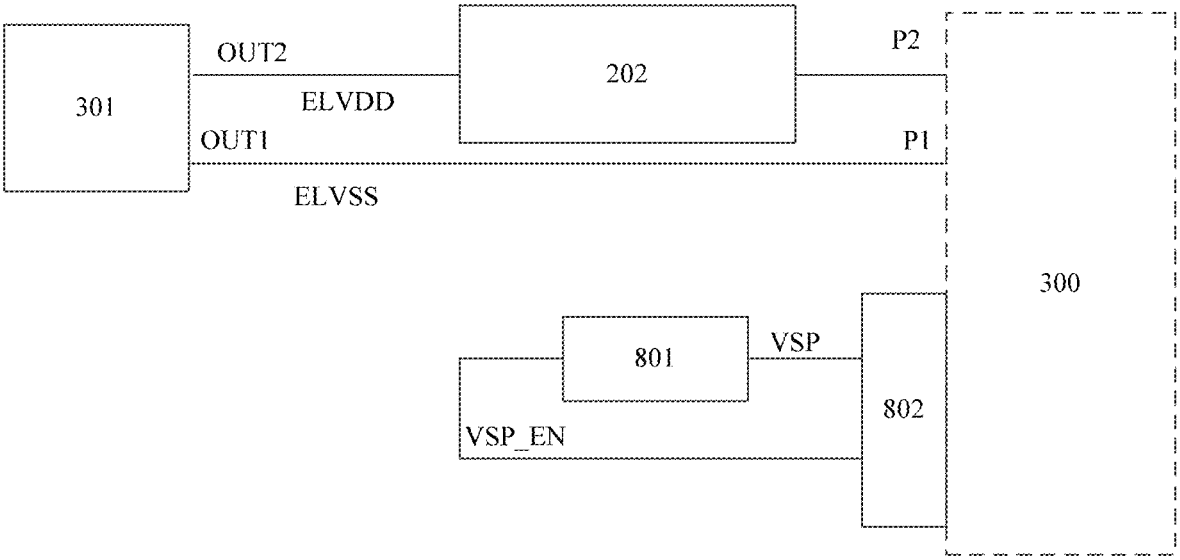
FIG. 8 is a schematic diagram of a power supply circuit according to an embodiment of the present disclosure.

In addition, according to an embodiment of the present disclosure, as illustrated in FIG. 8, the power supply circuit of the display screen further comprises a driving power chip 801, and the driving power chip 801 can output a driving voltage VSP under the control of the driving enable signal VSP_EN to provide power to a driving chip 802 of the display screen by the driving power VSP.

According to the above embodiments of the present disclosure, the first output terminal of the power chip is connected to the first power receiving terminal of the display screen to provide the first preset voltage provided by the power chip to the first power receiving terminal, and the second output terminal of the power chip is connected to the second power receiving terminal of the display screen through the output terminal of the delay sub-circuit to delay the second preset voltage provided by the power chip for a preset delay time period and then output the delayed second preset voltage to the second power receiving terminal, so that the power-off protection caused by a large current or the phenomenon that a voltage is pulled up during the powering process of the power chip can be effectively avoided, and the power-off protection performed during the powering process can be avoided as much as possible while preventing the display screen from being damaged, and the subsequent detection can be assuredly performed in a normal way. The circuit has a simple structure and good compatibility.

At least one embodiment of the present disclosure further provides a display device, and the display device comprises the power supply circuit provided by the above embodiments. The display device is, for example, an OLED display device, which comprises a display screen. The display screen comprises a plurality of sub-pixel units that are arranged in an array, each sub-pixel unit comprises a pixel circuit, and the pixel circuit comprises an OLED device. The OLED device is provided with the above second preset voltage ELVDD and the first preset voltage ELVDD by the control of the pixel circuit and emits light in a corresponding grayscale according to a data voltage.

By the above power supply circuit, in the display device provided by the embodiment of the present disclosure, the power-off protection caused by a large current or a phenomenon that a voltage is pulled up during the powering process of the power chip can be effectively avoided, and the power-off protection performed during the powering process can be avoided as much as possible while preventing the display screen from being damaged, and the subsequent detection can be assuredly performed in a normal way.

Corresponding to the power supply circuit of the display screen provided in the above embodiments, an embodiment of the present disclosure further provides a power supply method, and the power supply method, for example, is used to provide power for a display screen. Because the power supply method of the display screen provided by the embodiment of the present disclosure corresponds to the power supply circuit of the display screen provided by the above embodiments, the implementations of the above power supply circuit of the display screen are also applicable to the power supply method of the display screen provided in this embodiment, and this embodiment is not described in detail again.

Figure 9:
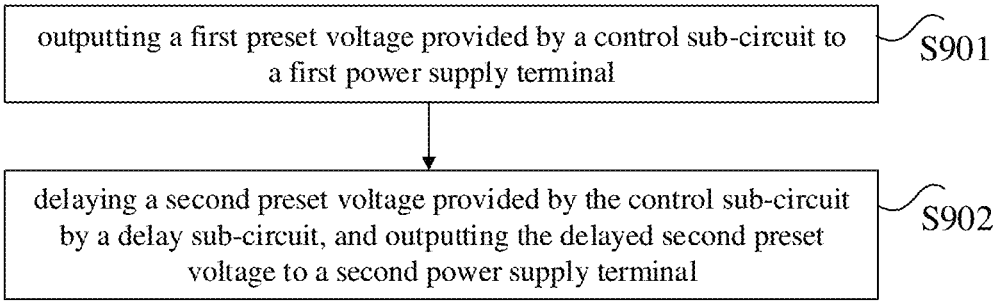
FIG. 9 is a flow diagram of a power supply method according to an embodiment of the present disclosure.

Another embodiment of the present disclosure further provides a power supply method, and the power supply method can be used in the display device provided by the embodiment of the present disclosure. As illustrated in FIG. 9, the power supply method comprises the following operations.

Step S901, outputting a first preset voltage provided by a control sub-circuit to a first power supply terminal.

Step S902, delaying a second preset voltage provided by the control sub-circuit by a delay sub-circuit, and outputting the delayed second preset voltage to a second power supply terminal.

Here, the control sub-circuit is a power chip, the first preset voltage is provided by a first output terminal of the power chip, and the first preset voltage provided by the power chip is output to the first power supply terminal; and the second preset voltage is provided by a second output terminal of the power chip, the second preset voltage is delayed to be output, and the delayed second output voltage is output to the second power supply terminal.

Figure 10:
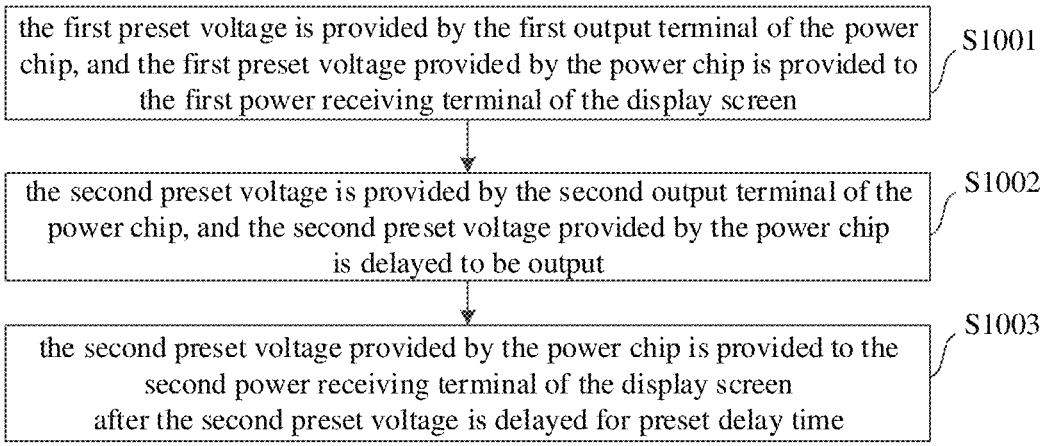
FIG. 10 is a delay flow diagram of a power supply method according to an embodiment of the present disclosure.

Specifically, as illustrated in FIG. 10, the first preset voltage is provided by the first output terminal of the power chip, and the first preset voltage provided by the power chip is provided to the first power receiving terminal of a display screen (step S1001); the second preset voltage is provided by the second output terminal of the power chip, and the second preset voltage provided by the power chip is delayed to be output (step S1002); and the second preset voltage provided by the power chip is provided to the second power receiving terminal of the display screen after the second preset voltage is delayed for a preset delay time period (step S1003).

Figure 11:
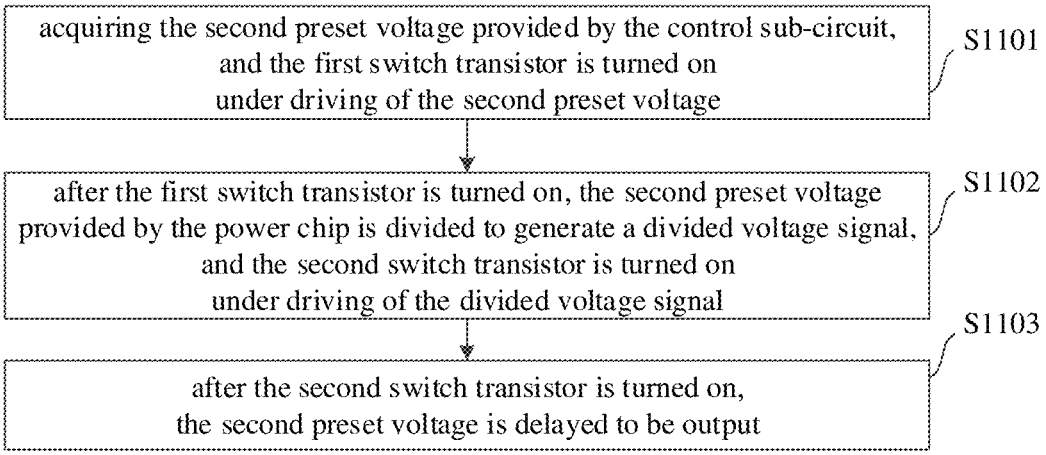
FIG. 11 is a delay flow diagram of a power supply method according to an embodiment of the present disclosure.

In addition, according to an embodiment of the present disclosure, the delay and output process is performed by a delay sub-circuit 403, and the delay sub-circuit 403 comprises a first switch transistor and a second switch transistor, as illustrated in FIG. 11, the delay and output process of the second preset voltage provided by the power chip comprises the following operations:

S1101: acquiring the second preset voltage provided by the control sub-circuit, and the first switch transistor is turned on under driving of the second preset voltage.

S1102: after the first switch transistor is turned on, the second preset voltage provided by the power chip is divided to generate a divided voltage signal, and the second switch transistor is turned on under driving of the divided voltage signal.

S1103: after the second switch transistor is turned on, the second preset voltage is delayed to be output.

In at least one embodiment of the present disclosure, the first preset voltage is provided by the first output terminal of the power chip, and the first preset voltage provided by the power chip is provided to the first power receiving terminal of a display screen. Besides, the second preset voltage is provided by the second output terminal of the power chip, and the second preset voltage provided by the power chip is delayed to be output, and the second preset voltage provided by the power chip is provided to the second power receiving terminal of the display screen after the second preset voltage is delayed for a preset delay time period, so that the power-off protection caused by a large current or the phenomenon that a voltage is pulled up during the powering process of the power chip can be effectively avoided, and the power-off protection performed during the powering process can be avoided as much as possible while preventing the display screen from being damaged, and the subsequent detection can be assuredly performed in a normal way.

What are described above is related to the illustrative embodiments of the disclosure only and not limitative to the scope of the disclosure; the scopes of the disclosure are defined by the accompanying claims.

What is claimed is:

1. A power supply circuit for a display screen, comprising:

a control sub-circuit, configured to provide a first preset voltage and a second preset voltage and output the first preset voltage to a first power supply terminal; and a delay sub-circuit, configured to delay the second preset voltage and output the delayed second preset voltage to a second power supply terminal during a powering process for the display screen, wherein the control sub-circuit is a power chip;

wherein the power chip comprises a first output terminal and a second output terminal, the first output terminal is configured to provide the first preset voltage, and the second output is configured to provide the second preset voltage, wherein the first output terminal is used as the first power supply terminal; and wherein the delay sub-circuit comprises an input terminal and an output terminal, the input terminal is connected to the second output terminal of the power chip, the output terminal of the delay sub-circuit is connected to the second power supply terminal to delay the second preset voltage provided by the power chip and output the delayed second preset voltage to the second power supply terminal, wherein the first power supply terminal is connected to a first power receiving terminal of a the display screen, and the second power supply terminal is connected to a second power receiving terminal of the display screen.

2. The power supply circuit according to claim 1, wherein the delay sub-circuit comprises:

a first switch transistor, wherein a control terminal of the first switch transistor is connected to the input terminal of the delay sub-circuit, and a first terminal of the first switch transistor is grounded;

a second switch transistor, wherein a first terminal of the second switch transistor is connected to the input terminal of the delay sub-circuit, and a second terminal of the second switch transistor is connected to the output terminal of the delay sub-circuit; and a voltage division and delay sub-circuit, wherein a first terminal of the voltage division and delay sub-circuit is connected to the input terminal of the delay sub-circuit, and a second terminal of the voltage division and delay sub-circuit is connected to the second terminal of the first switch transistor, a voltage division terminal of the voltage division and delay sub-circuit is connected to a control terminal of the second switch transistor, and a delay terminal of the voltage division and delay sub-circuit is connected to the output terminal of the delay sub-circuit after the delay terminal of the voltage division and delay sub-circuit is connected to the second terminal of the second switch transistor.

3. The power supply circuit according to claim 2, wherein the first switch transistor is an NMOS transistor, and the second switch transistor is a PMOS transistor.

4. The power supply circuit according to claim 2, wherein where the second preset voltage provided by the control sub-circuit is input to the input terminal of the delay sub-circuit, the first switch transistor is turned on under driving of the second preset voltage;

the voltage division and delay sub-circuit is configured to divide the second preset voltage provided by the power chip, after the first switch transistor is turned on, to generate a divided voltage signal and output the divided voltage signal through the voltage division terminal to the second switch transistor to drive the second switch transistor to be turned on;

after the second switch is turned on, the second preset voltage is delayed to be output.

5. The power supply circuit according to claim 2, wherein the voltage division and delay sub-circuit comprises:

a first resistor, wherein a first terminal of the first resistor is used as the second terminal of the voltage division and delay sub-circuit, and a second terminal of the first resistor is connected to the voltage division terminal of the voltage division and delay sub-circuit; and a second resistor, wherein a first terminal of the second resistor is used as the first terminal of the voltage division and delay sub-circuit, and a second terminal of the second resistor is connected to the voltage division terminal of the voltage division and delay sub-circuit.

6. The power supply circuit according to claim 5, wherein the voltage division and delay sub-circuit further comprises:

a first capacitor, wherein a first terminal of the first capacitor is connected to the voltage division terminal of the voltage division and delay sub-circuit, and a second terminal of the first capacitor is used as the delay terminal of the voltage division and delay sub-circuit.

7. The power supply circuit according to claim 5, wherein the voltage division and delay sub-circuit further comprises:

a second capacitor, wherein a first terminal of the second capacitor is connected to the first terminal of the second resistor, and a second terminal of the second capacitor is connected to the second terminal of the second resistor.

8. The power supply circuit according to claim 6, wherein a preset delay time period of the delay sub-circuit is R1*C1*Ln ((ELVDD_IN−ELVDD_OUT)/ELVDD_IN), where R1 is a resistance value of the first resistor, C1 is a capacitance value of the second capacitor, ELVDD_IN is a voltage of the input terminal of the delay sub-circuit, ELVDD_OUT is a voltage of the output terminal of the delay sub-circuit, and Ln is a natural logarithm.

9. A display device, comprising the power supply circuit according to claim 1.

10. A power supply method for a display screen, comprising:

outputting a first preset voltage provided by a control sub-circuit to a first power supply terminal; and delaying a second preset voltage provided by the control sub-circuit by a delay sub-circuit, and outputting the delayed second preset voltage to a second power supply terminal during a powering process of the display screen, wherein the control sub-circuit is a power chip;

wherein the first preset voltage is provided by a first output terminal of the power chip, and the first preset voltage provided by the power chip is output to the first power supply terminal;

wherein the second preset voltage is provided by a second output terminal of the power chip, the second preset voltage is delayed to be output, and the delayed second output voltage is output to the second power supply terminal.

11. The power supply method according to claim 10, wherein the delay sub-circuit comprises a first switch transistor and a second switch transistor, and delaying the second preset voltage provided by the control sub-circuit by the delay sub-circuit comprises:

acquiring the second preset voltage provided by the control sub-circuit, wherein the first switch transistor is turned on under driving of the second preset voltage;

after the first switch transistor is turned on, the second preset voltage provided by the power chip is divided to generate a divided voltage signal, wherein the second switch transistor is turned on under driving of the divided voltage signal; and after the second switch transistor is turned on, the second preset voltage is delayed to be output.

12. The power supply circuit according to claim 3, wherein where the second preset voltage provided by the control sub-circuit is input to the input terminal of the delay sub-circuit, the first switch transistor is turned on under driving of the second preset voltage;

the voltage division and delay sub-circuit is configured to divide the second preset voltage provided by the power chip, after the first switch transistor is turned on, to generate a divided voltage signal and output the divided voltage signal through the voltage division terminal to the second switch transistor to drive the second switch transistor to be turned on;

after the second switch is turned on, the second preset voltage is delayed to be output.

13. The power supply circuit according to claim 3, wherein the voltage division and delay sub-circuit comprises:

a first resistor, wherein a first terminal of the first resistor is used as the second terminal of the voltage division and delay sub-circuit, and a second terminal of the first resistor is connected to the voltage division terminal of the voltage division and delay sub-circuit; and a second resistor, wherein a first terminal of the second resistor is used as the first terminal of the voltage division and delay sub-circuit, and a second terminal of the second resistor is connected to the voltage division terminal of the voltage division and delay sub-circuit.

14. The power supply circuit according to claim 13, wherein the voltage division and delay sub-circuit further comprises:

a first capacitor, wherein a first terminal of the first capacitor is connected to the voltage division terminal of the voltage division and delay sub-circuit, and a second terminal of the first capacitor is used as the delay terminal of the voltage division and delay sub-circuit.

15. The power supply circuit according to claim 13, wherein the voltage division and delay sub-circuit further comprises:

a second capacitor, wherein a first terminal of the second capacitor is connected to the first terminal of the second resistor, and a second terminal of the second capacitor is connected to the second terminal of the second resistor.

16. The power supply circuit according to claim 4, wherein the voltage division and delay sub-circuit comprises:

a first resistor, wherein a first terminal of the first resistor is used as the second terminal of the voltage division and delay sub-circuit, and a second terminal of the first resistor is connected to the voltage division terminal of the voltage division and delay sub-circuit; and a second resistor, wherein a first terminal of the second resistor is used as the first terminal of the voltage division and delay sub-circuit, and a second terminal of the second resistor is connected to the voltage division terminal of the voltage division and delay sub-circuit.

17. The power supply circuit according to claim 16, wherein the voltage division and delay sub-circuit further comprises:

a first capacitor, wherein a first terminal of the first capacitor is connected to the voltage division terminal of the voltage division and delay sub-circuit, and a second terminal of the first capacitor is used as the delay terminal of the voltage division and delay sub-circuit.

18. The power supply circuit according to claim 16, wherein the voltage division and delay sub-circuit further comprises:

a second capacitor, wherein a first terminal of the second capacitor is connected to the first terminal of the second resistor, and a second terminal of the second capacitor is connected to the second terminal of the second resistor.

* * * * *